US010004318B1

(12) United States Patent
Levneff et al.

(10) Patent No.: US 10,004,318 B1
(45) Date of Patent: Jun. 26, 2018

(54) EYE COSMETIC APPLICATOR

(71) Applicants: Liya Levneff, Forest Hills, NY (US); Yuriy Leviyev, Forest Hills, NY (US)

(72) Inventors: Liya Levneff, Forest Hills, NY (US); Yuriy Leviyev, Forest Hills, NY (US)

( * ) Notice: Subject to any disclaimer, the term of this patent is extended or adjusted under 35 U.S.C. 154(b) by 0 days. days.

(21) Appl. No.: 15/335,472

(22) Filed: Oct. 27, 2016

(51) Int. Cl.
*A45D 40/24* (2006.01)
*A45D 40/20* (2006.01)
*A45D 40/26* (2006.01)

(52) U.S. Cl.
CPC ..... *A45D 40/24* (2013.01); *A45D 40/20* (2013.01); *A45D 40/261* (2013.01); *A45D 40/262* (2013.01); *A45D 2200/1072* (2013.01)

(58) Field of Classification Search
CPC .. A45D 40/20; A45D 40/24; A45D 2040/208; B43K 23/004; B43K 23/06
USPC ..... 401/6, 88
See application file for complete search history.

(56) References Cited

U.S. PATENT DOCUMENTS

2001/0024591 A1* 9/2001 Tani ..... A45D 40/04 401/68
2013/0209155 A1* 8/2013 Hilton Dunne ..... B43K 23/016 401/6
2016/0073766 A1* 3/2016 Cochran ..... A45D 40/26 401/118

FOREIGN PATENT DOCUMENTS

FR 2898469 A1 * 9/2007 ..... A45D 40/24

* cited by examiner

*Primary Examiner* — Jennifer C Chiang
*Assistant Examiner* — Bradley Oliver
(74) *Attorney, Agent, or Firm* — Andrew S. Langsam; Pryor Cashman LLP

(57) ABSTRACT

An eye liner and/or eye brow cosmetic applicator device comprises a cylindrical handle segment and one or preferably two angled eye liner and eye brow cosmetic holding containers and applicators having a roller ball, tip, nib or a brush in communication with eye liner and eye brow cosmetic material contained within the containers at the angled ends of the device. The containers are removably connected to the handle for selective replacement. Caps or coverings are provided to the working tips of the containers and, in one embodiment, a smudger cap is provided, too. The caps are frictionally retained. The handle segments are preferably rotatably secured to one another for providing flexibility in rotation of each handle segment with respect to the other handle segment.

14 Claims, 3 Drawing Sheets

EYE COSMETIC APPLICATOR

BACKGROUND OF THE INVENTION

The present invention relates to an eye liner or eye-related cosmetic applicator for use by individuals doing their own eye make-up or even for use by one person (whether a professional or not) on the eyes of another. Thus the present invention relates to a cosmetic make-up applicator, primarily and preferably for eye-liner but the same invention can also be used for purposes of filling in eyebrows and sculpting the same, all in the personal cosmetics and beauty field. The device is intended to be pencil-like in its ease of handling, size, and application of eye liner to the wearer's water line, eye lid, eye brow and skin. The preferred embodiment is meant to be inexpensive to manufacturer and thus inexpensive to purchase and can be provided with color and specific applicator tip options, to the benefit of the manufacturer and the consumer. Thus, the consumer can purchase, for example, a single device having two application tip ends each supplied by separate eye liner or eye brow material reservoirs or containers, with each end of the single handle having the same or a different container of eye liner or eye brow filler and applicator tip. Each make-up container with an application tip can provide the same or a different color as one another, can have at the two ends a different applicator contact mechanism or the same as one another e.g., a brush on one end and a pencil-making fine line on the other; a fine line and a thicker or medium line; a small brush and a larger brush; a roller ball and a small brush; larger roller ball and smaller roller ball; etc. and, as each end is provided with liquid or conventional composition material from the container, as it is used up or spent, the consumer can replace that container, or that brush, tip, or skin/eye applicator or tip member, with a new container having the same or a different color, applicator, etc. This results in great flexibility for the manufacturer, the retail store and the consumer.

The present invention is an eye liner and/or cosmetic eye application device with two containers for holding a reservoir of eye liner or eye brow filler and each container having a working tip or an eye liner eye brow applicator contact end. In the preferred embodiment, the tips or skin contacting ends are secured to the distal ends of the cylindrical containers containing eye liner or eye brow (hereinafter for ease of reading and comprehension, the specification may read as "eye liner" but it is clearly understood that the invention extends to and includes eye brow filler, too) material. In the preferred embodiment, the containers and/or the skin contact ends (brushes, roller balls, fine-line pen-like tips, pencil tips, etc.) are selectively securable to the opposed or outward ends of a single central handle. The handle is about four fingers in width so that a user can easily and accurately hold the same with a thumb on the opposed side and thus accurately use the contact tip near to the eye or on the eye brow. The skin-contacting tips are preferably covered with a cap, in one embodiment by a smudging member, a small, angled, piece of foam (or any soft material, including natural and artificial material such as polyester, cotton, plastic, etc.) which allows and facilitates the after-application smudging of the first "pass" of eye liner on or around the eye or eye brow. The smudging cap can blend the eye liner or eye brow filler in and around the eye and more smoothly transition the eye cosmetic color and its points of application to the other skin tone or make up in or around the eye. The smudging cap, like a shaped, triangular, preferably cylindrical or pyrimidical cone or oval in cross section; square, rectangular or even irregular shaped) sponge, serves, when placed over the applicator's contact end (brush, roller ball, fine tip, etc.) to substantially block further liquid or cosmetic eye liner material from inadvertently oozing out of the container onto surfaces where that application is not desired, e.g., one's purse, blouse, etc. In another embodiment, the smudging tip or cap is itself covered over by a second or protective cap, the second cap being frictionally held over the smudge cap and, yet, easily removed by the fingers. Preferably, the second cap is frictionally held to the device over the smudge cap and both caps can be removed together as one—or the outside or second cap first removed to expose the smudge cap and then it can be removed for exposing the primary eye liner or eye brow applicator (brush, roller ball, or pen-like tip).

In the preferred embodiment, the handle is cylindrical and defines a longitudinal axis passing through and down its center line. In the preferred embodiment the handle is cylindrical but other shapes and cross sections can be used. The containers or reservoirs for the cosmetics are secured to the outer ends of the handle, preferably by male and female mechanical connections, i.e., the ends of the handle could be provided with internal screw threads and one end of the container provided with male, external and mating screw threads to the female internal screw threads so that the containers or eye liner holding or eye brow cosmetic-holding vessels are easily screwed into and held to the ends of the handle and replaced as and when desired. Alternatively, the containers are integral with the handle, not removable, so that the entire device can be discarded when desired. In one embodiment of the device the longitudinal axis passing through the handle and the longitudinal axis of the attached containers define a sharp and obtuse angle. In an alternate embodiment of the invention, the longitudinal axis of the handle and that of the containers is a sharp obtuse angle but the connections define smooth curves.

In the preferred embodiment, the tips of the two ends of the eye liner and/or eye brow applicator are directed in opposed directions from one another and at angles to the handle. In the preferred embodiment, one of the tips of the applicator is angled upwardly from the handle and the other end angled downwardly. This is intended to provide ease of use, precision in application, decreased mess, and ease of handling. Indeed, in the preferred embodiment the device resembles an abstract "S" shape as a consequence of the working tips of the cosmetic, the eye liner and eye brow applicators, extending at angles to the central handle and in opposite directions from the handle.

DESCRIPTION OF THE PRIOR ART

Eye liner and cosmetic applicators have been in use for years and are being sold to consumers in large quantities. Generally, consumers have large choices from those offered by the manufacturers. The available devices use a variety of application ends, e.g., roller balls, brushes, thin and thick pen-like nibs, pencils, etc. Generally, a single type of application tip is offered for sale with a single color of eye liner or eye brow pencil or marker. It would be an advantage to a consumer to provide, as a purchasing choice, a single eye liner and eye brow application device which allows the consumer to mix and match two or more eye liner and/or eye brow colors, eye liner material (with and without sparkles), application tips, sizes of brushes, roller balls, pen-like nibs, etc. Also, it would be advantageous to the manufacturer, retailer and the consumer to allow the consumer to mix and match application tips and to provide a single device which can allow for easy application of two colors, or two different tips (style or size/width) and/or for the selective replacement of the containers for the eye liner or eye brow cosmetic when one container is spent or exhausted, without prematurely throwing out the other container and its contents of eye liner and/or eye brow cosmetic material. These and other advantages are provided by the present invention.

As mentioned, there currently exist eye liners and eye brow pencils which have simple, cylindrical holding containers for the eye liner and cosmetic material. The contents are applied by use of a small brush or a pencil or pen-like nib to the water line of the eye, the outside edge, the skin, eye brow, etc. In addition, pencils of various color are used, too, for application of eye liner. These can be of various thicknesses of pencil tip. And, there are eye liners which are quite similar to pens drawing on the near liquid contents of containers for fluidly and precisely drawing on the eye and adjacent skin.

The present invention provides a simple handle which can have one or two containers of eye liner material selectively attached (and removed when spent) and new containers reattached, where each container can provide the same or a different color, material, application tip, style, size or width, etc. And, the present invention provides an eye liner applicator where a single handle is used with two (or more) containers of eye liner material, where the handle allows both of the eye liner and eye brow cosmetic colors, materials, or application tips to be easily and quickly used by a simple and easy flip over of the device within the user's hand. The S shape of the handle and the two containers attached to the handle provide a very effective eye liner cosmetic application device.

SUMMARY OF THE INVENTION

The present invention comprises a single and centrally located handle, preferably cylindrical and extending about the length of a user's hand or four fingers (with the thumb on the opposite side as the four fingers). At the ends of the handle are complimentary male or female screw threads or another similar complementary mechanical mating mechanism (snap components). Containers of eye liner material are provided, preferably in cylindrical form and, on one end of each, the mating complementary attachment mechanism is provided to secure the same to the handle's ends. Thus, if the handle is provided with a female and interior set of screw threads at both ends, then the containers will preferably be provided with a set of male and exterior set of screw threads for allowing the containers to be easily screwed onto and removed from (for replacement and change) the female ends of the handle, as desired. The other or distal ends of the containers are preferably provided with an one of selected eye-liner or eye brow application tips, either in the form of a roller ball, a brush, a pen or pencil-like nib or surface, etc. The application tip, of course, obtains cosmetic material for application of eye liner or eye brow cosmetic from the interior of the container. Controlled application of the eye liner material is thus provided.

In an alternate embodiment of the invention, the central section of the handle can be provided with a twistable section, like the corrugated and bendable section of a plastic or paper straw, to allow the handle to fold upon itself and thereby draw one distal end and container near to the other, for space saving purposes. Other mechanisms can be provided, too, for allowing the central handle to rotate, twist, turn upon itself, etc.

In one embodiment of the invention, the applicator tip of at least one of the containers is provided with a friction-fitting smudge cover which, preferably, is a tapered sponge-like (or other soft surface) tip which allows for selective smooth smudging of the applied eye liner or eye brow cosmetic while, at the same time, also capping the container. In another embodiment of the invention, the smudge cover is itself provided with a friction fit cover so that the smudge cover does not mark upon or come into contact with any other surface than near the eye, as desired.

According to the preferred embodiment, the handle is somewhat short and cylindrical and the containers extend from the ends of the handle at angles, preferably the same angle, but opposed to one another as defined by the axis of the handle. Thus, the containers are oppositely directed from the handle in the same manner of the ends of the letter "S." One container extends at an angle to the handle in one direction and the other, opposed container, extends at the same or a different angle to the handle but in an opposite direction. So, if the longitudinal handle "corresponds" or is overlaid over the Y axis of a graph, a first container will extend from the origin and extend into the I quadrant, where X is positive and Y is positive, and the other container will extend into the III quadrant, from the origin, here X is negative and Y is negative. Preferably the angles defined by the longitudinal axis of the containers with respect to the longitudinal axis of the handle are in the range of between 90 degrees to 170 degrees but, more preferably, define an angle of about 135 degrees.

In an alternate embodiment of the invention, the central portion of the handle is provided with two interconnecting components, one on the central end (not the end with the make up) of each. One of the central ends of a first part of the handle is provided with a male, round pin-like component and the other central end of the second part of the handle (with the other cosmetic container on its distal end) is provided with a corresponding female socket end for the male component. In effect they serve as a rotatable joint allowing the handle to rotate about this central connection in the middle of the handle. The male pin component is held within the female socket component by a friction fit or, alternatively, by a detente ball(s) like that used in a telescopic umbrella. This provides the free ends of the cosmetic device to be rotated such that the free ends, with the cosmetic containers and applicators, are near to one another or pointed away from one another. Other mechanical and rotatable connections between the segments of the handle of the device can be use, too, of course.

DETAILED DESCRIPTION OF THE DRAWINGS AND THE PREFERRED EMBODIMENT

Figure 1:
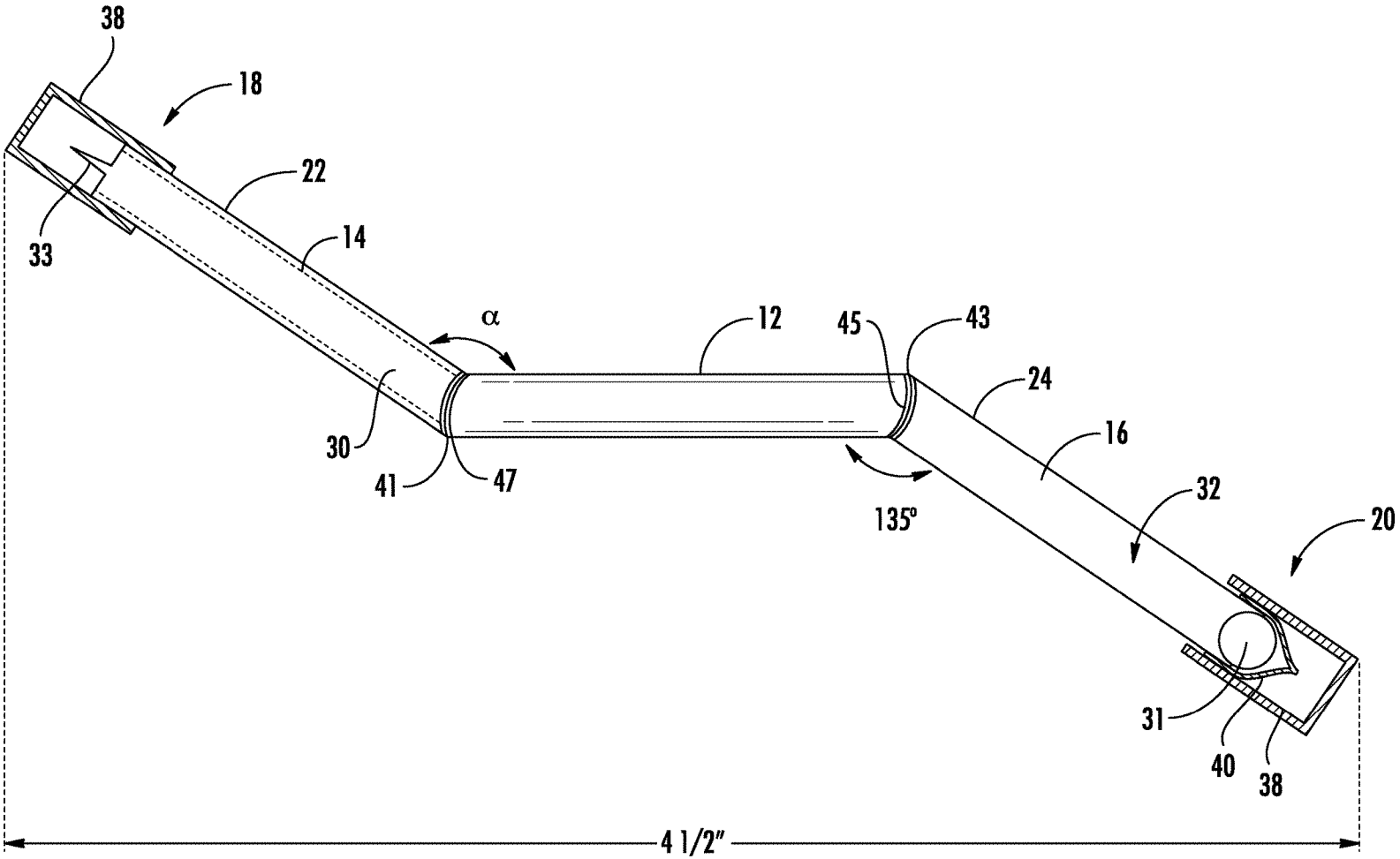
FIG. 1 is a perspective view of the preferred embodiment of the invention.

As seen in FIG. 1, an eye liner and eye brow fill in cosmetic applicator is provided. It is generally of a round cross section although other shapes, (triangular, square, rectangular, hexagon, oval, etc.) are also within the scope of the present invention. From the top or a side, the eye liner applicator 10 appears like an elongated "S" shape, comprised of a central handle section 12 and two outwardly extending cosmetic, container-holding segments, 14 and 16. The ends 18 and 20 of the segments 14 and 16 extend away from one another and, preferably, the lengths 22 and 24 of the segments 14 and 16 are somewhat parallel to one another. Of course, the ends 18 and 20 of the segments 14 and 16 could extend away from one another (like a "U" shape) and, yet, the lengths 22 and 24 might be non-parallel to one another, i.e., the longitudinal axis passing through the segments could cross one another, if extended beyond the handle section 12. In the embodiment shown, the segments 14 and 16 are parallel but directed away from one another so that, if the device were laid upon a grid with an X-Y axis, with the Y axis beneath the longitudinal axis of the handle 12, the segment 14 would lie in the I quadrant of the grid, where X and Y are positive, while the segment 16 lies in the III quadrant, where both X and Y are negative.

The two ends 18 and 20 of the eye liner and eye brow cosmetic applicator 10 are preferably provided with working ends which are related but different from one another to provide versatility to the device for use in cosmetic make-up, specifically, eye liner and eye brow filler, application to a human face—the emphasis being the eyes. One end could be provided with a roller ball 31, for example, or a fine brush, for application of eye liner, while the opposite end could be provided with, for example, a roller ball of a different diameter for the same or a different color of eye liner or eye brow fill in cosmetic, a brush with a different width, a smudging sponge, a roller ball of the same diameter as the first but for application of a different color eye liner or eye brow, or a pencil or pen nib 33. Preferably, the two ends of the eye liner applicator 10 are coordinated in some manner to one another to provide an eye liner and eye brow cosmetic applicator with great utility for the user in a coordinated and fashionable manner.

The lengths 22 and 24 of the applicator 10 are preferably the same diameter as the handle and cylindrical (as is the handle), but could be other cross sectional diameters and shapes. In any shape, however, the lengths are holding compartments, vessels, or containers for a reasonable (at least one application to each eye is considered the minimum) number of applications. The compartments for holding the eye liner and eye brow cosmetic material are closed on their proximal ends (near to the handle) and the roller ball or brushes, in fluid or material communication with the contents of the compartments of the lengths, are located at the distal ends. Conventional eye liner and other cosmetic applicators currently exist which use roller balls for application of the same, brushes are available, too, as are pencil liners and pen nibs, etc. Thus the technology for the compartments, the sealing of the same, the capture, release, obtaining smooth material to the roller ball and/or the brush(es) is all well known.

The handle section of the eye liner applicator is sufficiently long so as to allow for either a hand (four fingers and the thumb on the other side) to be gripped around it and/or for at least the thumb and forefinger, all to allow for ease of application of the eye liner and eye brow filler of cosmetics onto the water line and skin adjacent the eyes of the wearer.

In the preferred embodiment, the containers 30 and 32 for the cosmetic eye liner and eye brow cosmetic material are removable and replaceable onto the handle. In this way, the user/consumer could replace spent containers of the eye liner and cosmetic eye brow material with new ones, mix the applicator's brushes with roller ball applicators, change the color of the eye liner or eye brow filler being carried by the device, the width of the brush tips, the type of eye liner, etc. In this regard, the proximal ends of the containers can be provided with a set of male screw threads 41, 43 which can be selectively screwed into suitable female screw threads 45, 47 or receivers in the ends of the handle. Other male and female mechanical connectors can be provided, too, (snaps and snap retainers) to allow for the containers to be swapped for other containers 30 and 32 to be held on the opposed ends of the applicator handle 12. In an alternate embodiment, of course, the containers are integral with the central handle and the entire device is disposable when one or both containers are spent or otherwise desired, or when one or the other container can be selectively replaceable when spent.

As can be appreciated, in the preferred embodiment the overall length of the device is generally desirably in the range of about 41 inches, measured between parallel vertical lines passing through each of the ends 18 and 20 of the device 10. In the preferred embodiment, the short lengths 22 and 24 are only about 1¼ inches in length but, surely, other dimensions are within the scope of the invention. The cylindrical containers or compartments 30 and 32 for holding the eye lining and eye brow cosmetics material are generally in the range of about ¼ to ¾ of an inch in diameter. Also, the angle defined by the longitudinal axis passing through the handle section 12 and a longitudinal axis passing through the short lengths or segments 22 and 24, respectively, is defined by angle alpha, and preferably is about 135 degrees. Each of those angles between the length or container and the handle need not be the same and can be different. Indeed, it is within the contemplation of the present invention that the angle defined between the axis of the short segments and the longitudinal axis of the handle be in the range from about 90 degrees (forming a U shape) to about 170 degrees. In one embodiment of the invention the connections between the containers and the handle are accomplished by elliptical planes at the ends of the containers sliding on one another. This thus defines a "hard" angle between the longitudinal axis of the handle and that of each container. In one alternate embodiment of the device the longitudinal axis passing through the handle and the longitudinal axis of the attached containers define a sharp and obtuse angle. In an alternate embodiment of the invention, the longitudinal axis of the handle and that of the containers are sharp obtuse angles but the connections define smooth curves, like a slithering snake. A radius of curvature is provided at the connections between the end of the handle and the non-working ends of the containers so that the handle gradually and gracefully becomes the containers.

A first end of the device is preferably provided with a roller ball applicator 31 for allowing ease of transfer and uniform application of the eye liner and/or eye brow cosmetic material from the container 32 to the water line and/or skin adjacent the eye of the user. The roller ball will "pick up" material when that side of the sphere is in contact with the contents of the container and then transfer the same to the water line or skin adjacent the eye of the user when it comes into contact with the same. Preferably, the roller ball is about 5-10 mm in diameter but other dimensions can be appropriate, extending down to even about 1 mm and up to about 15 mm in diameter. The other end 18 of the device 10 can be provided with another roller ball (same or different diameter), with a different color eye liner or eye brow cosmetic material. Alternatively, one end can be provided with a roller ball applicator and the other end provided with a thin liner brush, ranging in width from about 1 mm to 5 mm, and even up to about 15 mm. In the embodiment shown in FIG. 1, the end 18 is provided with a pen-like nib 33 for defining a fine line of eye liner to the water line of the eye and to the adjacent skin of the eye for eye brow cosmetic material.

According to the present invention, each of the ends of the device are preferably covered with a covering cap or device for protecting the roller balls, pencil tips, nibs or brush applicators from accidentally coming into contact with clothes, other body parts, other people, etc. In one embodiment, the covers 38 are merely friction fit caps which slide over the exposed ends of the application surface (roller ball or brush) and frictionally grip the sides of the device, just behind (closer to the handle) the roller ball or brush. In another embodiment, an intermediate smudger cap, 40 is provided. Smudger cap 40 is also a friction fit over the end of the roller ball or brush or nib and presents a soft, smooth, preferably foam surface for easily smudging (a common practice in smoothing the transition of color applied by the eye liner to the surrounding skin of the eye). This surface can be sponge-like on the outside application surface but is sufficiently rigid, on its concave end, to allow the same to be easily and securely placed on the working tip or end of the applicator and removed, as desired. In another embodiment of the present invention, the smudger cap 40 is removably secured to the application end 20 of the device and then the protective cap 38, preferably transparent, is frictionally secured over the smudger cap 40. This protects the smudger cap from contact with another person or object. Then, when desirably used, the cap 38 can be removed to expose the smudger cap. Then, if it is desired to remove the smudger cap 40, it can be removed by first replacing the cap 38 and squeezing the resilent sides of the cap 38 so that it and the smudger cap are simultaneously removed, exposing the roller ball, tip or nib, or the brush. Alternate mechanical arrangements can be used for providing a smudger cap to the roller ball (or brush) and providing an overall cap for the smudger cap which overall cap also can be placed upon and securely held to the end of the device, protecting the roller ball, tip, nib or the brush, in the event that no smudger cap is used.

The present invention, in its preferred embodiment, contemplates, as mentioned, that the handle can selectively receive a material container (preferably cylindrical) which when spent can be selectively replaced by a new container with the same or a different applicator, eye liner or eye brow cosmetic material, or color of eye liner as used or, of course, for versatility, a new color, type of or size applicator, or material (matte finish, gloss, glitter entrained, etc.). Alternatively, of course, the device can be disposable such that a single container either on one or both ends, when spent by application, results in the user throwing the entire applicator away and replacing the same, as needed.

In an alternate embodiment the end(s) 18 and 20 and the segments or lengths 14 and 16 are secured to the outside ends of the handle 12 by a ball and resilient capturing socket joint to permit the adjustment of the angle of the applicator's ends with respect to the handle.

In an alternate embodiment of the present invention, the central segment of the handle is provided with a rotatable mechanical connection to allow the two handle segments with their cosmetic containers and applicators to rotate with respect to one another so that the applicators can actually be rotated to be near one another and distal from one another. This type of connection is shown in FIG. 3. There, it should be appreciated, the two handle segments are connected together by a projecting center pin 201 in the middle of the overall device, but on one end of the handle segment not provided with a cosmetic container, sliding into a central blind bore 203, opposing the pin 201, and on the end of the other handle segment, also on the end thereof not provided with a cosmetic container. The center 116 of FIG. 2 can be replaced by a small outwardly extending post or pin 201 (aligned with the handle segment's longitudinal axis) as a male component and it will frictionally be held in a female blind bore 203 in the opposed end of the other handle segment. In one embodiment of the invention, the pin and the bore are maintained in rotatable contact by a small détente ball with a back spring and a corresponding hole of the blind bore, or vice versa, similar to the manner of the manner by which a telescopic handle of a collapsible umbrella is held together. With the male pin 201 and female bore 203 of the opposed handle segments, the two ends can rotate, one around the other, so that both ends with cosmetic containers and applicators can have their application tips or ends proximal or distal to one another. In this embodiment, the longitudinal axis of one handle segment is aligned with the longitudinal axis of the other handle segment and, yet, the handle segments rotate about their longitudinal axis, and about the other handle segment's axis. This provides the cosmetic applicator with great geometric versatility.

In an alternate embodiment of the invention, the container's material contents are advanced and pushed towards the working end of the device (brush or roller ball) as a material advancing wheel is rotated about the axis of the container. This can operate in a manner similar to current mechanisms now in use for lipstick applications, lip balm, deodorant rollers, etc.

Figure 2:
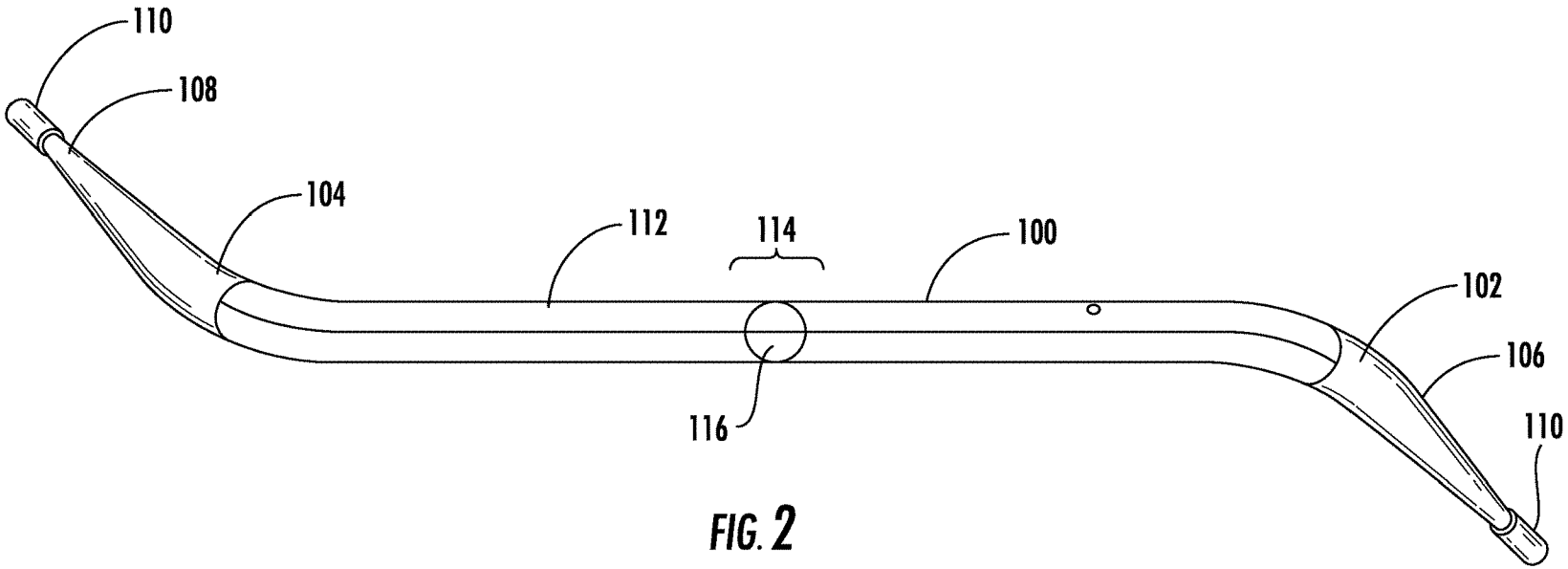
FIG. 2 is a similar perspective view of another and more streamlined embodiment of the present invention.
Figure 3:
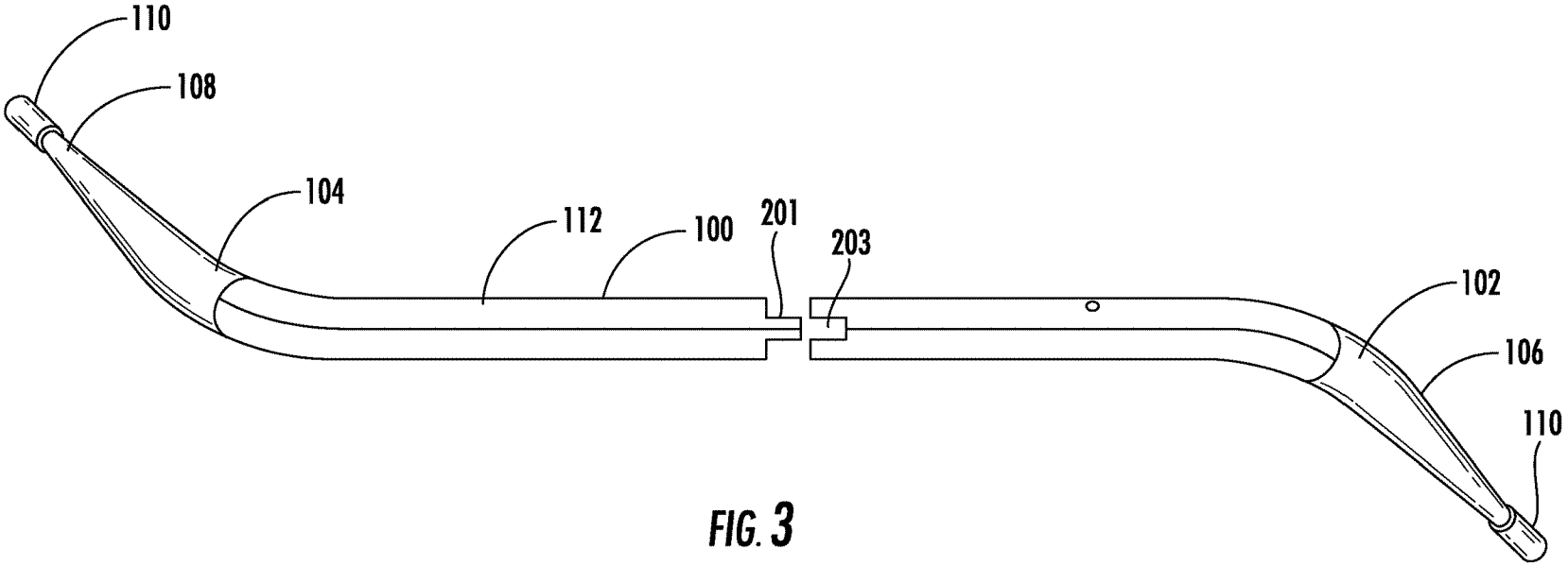
FIG. 3 is an enlarged and partial view of another embodiment of the central area of the handle and shows a simple male plug or pin insertable into and rotatable about a female socket of the other segment of the handle.

In the embodiment of the invention shown in FIG. 2, the cosmetic applicator 100 is provided with opposed ends 102 and 104 which are gradually tapered toward their working tips 106 and 108 and provided with simple, rubber caps 110, which are frictional held over the working tips until desirably removed for use. After use, the rubber caps 110 are replaced and held over to close the working tips 106 and 108 of the opposed ends 102 and 104. Here, as in the other embodiment, the central section 112 of the cosmetic applicator, the handle, is preferably cylindrical (circular in cross section) from the opposed ends 102 and 104 inwardly. Of course, the central section 112 can have a square, rectangular, hexagon, octagon, or other cross sectional shape. At the middle 114 of the applicator 100 shown in FIG. 2, a hinge or pivot feature 116 is provided. This can be a ball and socket like joint, or an extended ear of one end of the middle 114 captured by a pair of spaced ears on the other end of the middle 114, with aligned apertures for a pivot pin passing therethrough. Other mechanical hinges would work and are within the scope of the present invention. The hinge allows one of the opposed ends, say 102 with its working end 106 to rotate with respect to the other and opposed end, 104, with its working tip 108, so that the device is bent upon itself and is thus more compact for travel and storage. Then, when one or the other end of the cosmetic applicator is desired to be used on one's face, the device is unfolded by rotating one end about the hinge with respect to the other end. With the two opposed ends 102 and 104 separated, the working tips 106 and 108 can be used (after removal of the rubber covering tip(s) 110 for the end sought to be used on one's face. Of course, the hinge 116 allows for infinite variation and flexibility of the angle of one of the axis of a first end with respect to the axis of the second end, as the device need not be fully opened for use. The hinge allows for flexibility of the device and for compact storage in one's purse or drawere. As will be appreciated, when one end is rotated above the hinge 116, 180 degrees, because the working tips are oppositely directed (one pointing to the $2^{nd}$ quadrant and the other toward a $4^{th}$ quadrant of a set of Cartesian coordinates of a graph, the two working tips will point together, separated by the thickness of the middle section of the applicator and the variation allowed by the hinge. The hinge components can have various detents or "stops" to hold the respective working ends with respect to one another, as desired.

What is claimed is:

1. An eye makeup applicator comprising a handle having two opposed ends and two eye liner or eyebrow cosmetic treatment ends, each comprising a container for eye makeup material, said eye liner or eyebrow cosmetic treatment ends projecting outwardly from the ends of said handle at an angle, wherein each of the ends of said handle are connected to a first treatment end at a first end of said handle and a second treatment end at a second end of said handle that is opposite the first end of said handle, each treatment end projecting from said handle at an adjustable angle with respect to said handle wherein said handle is comprised of two handle segments, and said handle segments are rotatably secured to one another so that each handle segment can rotate about its longitudinal axis with respect to the longitudinal axis of the other handle segment.

2. An eye makeup applicator as claimed in claim 1 wherein at least one of said treatment ends is adjustable with respect to said angle in the range of about 90 degrees to about 170 degrees.

3. An eye makeup applicator as claimed in claim 2 wherein said angle is in the range of about 135 degrees.

4. An eye makeup applicator as claimed in claim 1 wherein said handle is sufficiently wide to accommodate a full four fingers of a hand.

5. An eye liner makeup applicator as claimed in claim 1 wherein said angle defined by a longitudinal axis passing through said handle and the longitudinal axis passing through at least one of said eye liner cosmetic treatment ends is in the range of is about 135 degrees.

6. An eye makeup applicator as claimed in claim 1 wherein the end of said eye liner or eye brow cosmetic treatment ends are provided with an applicator comprising any one of either a brush, tip, nib or a roller ball.

7. An eye makeup applicator as claimed in claim 1 wherein said handle and said container are circular in cross section.

8. An eye makeup applicator as claimed in claim 1 wherein said eye liner or eye brow cosmetic treatment ends of said applicator are incrementally adjustably angularly secured to said handle.

9. An eye makeup applicator as claimed in claim 1 wherein said containers are replaceably secured to the ends of said handle by complementary male and female mechanical connections.

10. An eye makeup applicator as claimed in claim 6 wherein said eye liner or eye brow cosmetic treatment end(s) are provided with a smudger end which is frictionally received over at least one of said eye liner or eye brow cosmetic treatment end.

11. An eye makeup applicator as claimed in claim 1 wherein said applicator extends from the first cosmetic treatment end or the second treatment end by a span distance of only about 4½ inches.

12. An eye makeup applicator as claimed in claim 1 wherein relative rotation of said container or a component mechanically connected to said container about a longitudinal axis of said containers results in the eye makeup material contents of said container being advanced toward at least one of said cosmetic treatment ends.

13. An eye makeup applicator as claimed in claim 1 wherein said handle segments are rotatably secured to one another by a male pin extending from one of said handle segments and a blind bore in the other of said handle segments.

14. An eye makeup applicator as claimed in claim 13 wherein said handle segments are held together by a detent mechanism.

* * * * *